United States Patent [19]

Libertini

[11] 4,183,207

[45] Jan. 15, 1980

[54] OIL-CONDUCTING STRUT FOR TURBINE ENGINES

[75] Inventor: Zoltan L. Libertini, Stamford, Conn.

[73] Assignee: Avco Corporation, Stratford, Conn.

[21] Appl. No.: 884,179

[22] Filed: Mar. 7, 1978

[51] Int. Cl.[2] ..... F02C 7/06

[52] U.S. Cl. ..... 60/39.08; 184/6.11

[58] Field of Search ..... 60/39.08, 39.32; 184/6.11; 415/115, 175, 136, 137; 285/192, 194, 116, 117

[56] References Cited

U.S. PATENT DOCUMENTS

| | | | |
|---|---|---|---|
| 2,439,447 | 4/1948 | Buck et al. | 308/77 |
| 2,474,258 | 6/1949 | Kroon | 415/175 |
| 2,620,157 | 12/1952 | Morley et al. | 415/136 |
| 2,639,579 | 5/1953 | Willgoos | 415/115 |
| 2,919,888 | 1/1960 | Simmons | 415/136 |
| 3,084,849 | 4/1963 | Dennison | 415/175 |
| 3,312,448 | 4/1967 | Hull et al. | 60/39.08 |
| 3,628,880 | 12/1971 | Smuland et al. | 415/115 |

FOREIGN PATENT DOCUMENTS

| | | | |
|---|---|---|---|
| 1001732 | 8/1965 | United Kingdom | 60/39.08 |

*Primary Examiner*—Louis J. Casaregola
*Attorney, Agent, or Firm*—Ralph D. Gelling

[57] ABSTRACT

A support strut for gas turbine engines is disclosed which includes an internal wall employed as a lubricating oil duct and which is separated from the outer wall to form an insulating chamber which is closed at one end and which is sealed at the other end by means of a sliding seal member which bridges the open end of the chamber. The sliding seal preferably is secured to the outer strut wall and includes a sleeve portion in telescoping engagement with the interior wall of the oil duct.

2 Claims, 2 Drawing Figures

OIL-CONDUCTING STRUT FOR TURBINE ENGINES

BACKGROUND OF THE INVENTION

The present invention relates to the support, lubrication and cooling of internal structures in gas turbine engines and is concerned, more particularly, with the provision of an oil conducting strut for supplying and scavenging or exhausting of lubricating and cooling oil to internal structures in turbine engines, such as bearings, while protecting the oil from the high temperature gases surrounding the strut and simultaneously accommodating differential thermal expansion of components of the strut to avoid both leakage of the oil under transfer and loss of the insulating property of the strut.

BRIEF DISCUSSION OF THE PRIOR ART

A variety of attempts have been made to provide for the transfer of fluids such as air or oil between the radially inner and outer portions of gas turbine engines. The more effective of these arrangements have incorporated the fluid transfer conduits within already existing, radial structures such as guide vanes or support struts, thereby avoiding the presentation of additional conduit structure to the air flow within the engine and the turbulence and pressure drop therein which would result from such additional structure.

U.S. Pat. No. 3,628,880, which issued Dec. 21, 1971 to Robert J. Smuland, discloses the concept of supplying cool air through apertured internal ducts within the vanes of a guide vane assembly to deliver coolant air to the interior of the vane and through portions thereof to provide a film-cooling affect along the surface of the vanes to protect the vane structure from the high temperature gases impinging on the exterior surfaces thereof.

U.S. Pat. No. 2,474,258, which issued June 28, 1949 to R. P. Kroon, discloses a turbine in which lubricating oil is traversed radially through guide vanes both to cool the oil and to provide for deicing of the intake vanes. The inner and outer ends of the hollow vanes are exposed in groups to inner and outer plenums with appropriate transfer of the oil in sequence through the groups of vanes to assure complete cooling of the oil and deliverance of adequate heat therefrom to the guide vanes.

U.S. Pat. No. 2,439,447, which issued Apr. 13, 1948 to R. S. Buck, discloses a turbine engine in which radial struts supporting a bearing in the high temperature zone of the engine are employed to supply both oil and coolant air into zones surrounding the bearings. In the strut supplying the oil to the bearing, a conventional pipe is passed through the hollow interior of the strut and is conventionally secured such as by threading. The oil emerging from the bearings is scavenged from the area by passage through the hollow portion of additional struts without thermal protection within the strut as it traverses the hot-gas flow path.

While these several approaches, in the conduction of fluids radially in a turbine engine by passage through already-present radial structures, have merit in the accomplishment of other purposes, they have not been found to be satisfactory in protecting lubricating and cooling oil which is passed through such radial structures in higher temperature zones of the engine. In the Buck U.S. Pat. No. 2,439,447, for example, the lubricating oil is supplied via a pipe-within-a-strut assembly, but is removed from the bearing via hollow strut structures without protection from the high temperature enforced in the strut walls by the surrounding hot gases. In the supply of the lubricant oil through an inner tube within a strut, the oil supply pipe is rigidly affixed at its ends and is subject to stresses and strains as a result of thermal expansion and contraction of the strut within which it is positioned, both with regard to the oil pipe itself and with regard to the bearing housing into which the oil pipe is threadably affixed. In continued service, this lack of accommodation of thermal variations in the structure leads to overstressing of components, cracks in joints and connections and a consequent leakage of the lubricating oil and reduces the acceptable service time of the engine between minor or major overhauls.

Therefore, the prior attempts in the provision for transfer of lubricating and cooling oils radially between inner and outer portions of gas turbine engines have not been found to entirely satisfactory.

SUMMARY OF THE INVENTION

In general, the preferred form of the present invention comprises a radial strut for the support of internal components of the engine and which includes a central oil passage which is surrounded by an insulating chamber which extends longitudinally of the strut throughout its radial extent in the gas flow path. The insulating chamber is fully closed at its radially inward end and is sealed, at its radially outer end, by means of a sliding seal member of complimentary cross-section which maintains the closure of the insulating chamber during differential expansion between the inner and outer walls forming the insulating chamber.

Preferably, the sliding seal member is affixed to the structural portion of the strut which is exposed to the hot gases and includes a sleeve portion which traverses the open end of the insulating chamber and engages the inner wall of the oil duct in a telescoping relationship. The supply and exhaust of lubricating and cooling oil to the oil duct may be effected in any manner convenient to the remaining structure of the engine, but preferably includes an enlarged chamber adjacent the sliding seal structure to accommodate the seal and provide access to the seal for mounting and servicing.

OBJECTS OF THE INVENTION

It is an object of the present invention to provide a thermally-protected assembly for transferring oil radially between inner and outer structures of a gas turbine.

It is another object of the present invention to provide a thermally protected oil passage through supporting struts of a turbine engine with insulation of the oil passage from the wall of the strut which is exposed to the flow path of the gases passing through the engine.

It is another object of the invention to provide an oil passage through a supporting strut of a turbine engine with an insulating chamber surrounding an oil passage duct within the strut and a seal at one end of the insulating chamber for accommodation of differential, thermal expansion of the duct walls and the strut structure.

It is a particular object of the present invention to provide a strut assembly for turbine engines having an oil duct therein which is surrounded by a closed, insulating chamber extending longitudinally of the strut throughout the zone of exposure thereof to the flow path of gases passing through the engine and an expansion-compensating seal bridging an otherwise open end of the insulating chamber and engaging the inner wall of the structure in a sliding, telescoping fit.

BRIEF DESCRIPTION OF THE DRAWINGS

These and other objects of the invention, as well as a better understanding thereof, may be derived from the following description and the accompanying drawings in which.

DETAILED DESCRIPTION OF THE PREFERRED EMBODIMENTS

Figure 2:
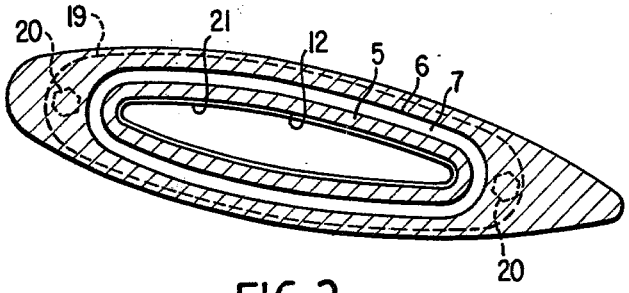
FIG. 2 is the cross-sectional view taken along the lines 22 of FIG. 1.

As shown in the drawings, the preferred form of oil-conducting strut according to the present invention comprises a main strut body I which extends radially inwardly from an external portion 2 to an internal structure 3 of an otherwise conventional gas turbine engine. In the region intermediate the external portion 2 and the internal structure 3, the strut body traverses the flow path 4 of the turbine and preferably is streamlined with regard to the flow path 4, as is best shown in FIG. 2.

Substantially throughout the full length of that portion of the strut traversing the gas flow path 4, the strut is formed of inner and outer walls, 5 and 6, respectively, which are separated by an intermediate ovate, annular gap or insulating chamber 7 which surrounds the inner wall 5. The insulating chamber 7 is closed at its inner end 8, preferably by forming the inner and outer walls 5 and 6 as an integral unit adjacent the inner structure 3, and includes an open end in the form of a generally ovate annular aperture 9 surrounding the open end 10 of the inner wall 5.

The outer portion of the strut includes a plenum recess 11 communicating with the hollow interior wall 12 of the inner wall 5 and includes a shoulder 13 surrounding the annular aperture 9. The recess 11 is closed by a cover 14 which is suitably secured to the remainder of the outer portion 2 such as by bolts 15 or by brazing and further communicates via an aperture 16 with an oil flow passage 17 in the outer portion 2.

Within the recess 11, an annular seal 18 is mounted with a peripheral flange 19 thereof sealing against the shoulder 13 and is secured thereagainst by suitable means such as bolts 20 or by brazing. The seal 18 includes an open sleeve portion 21 and a convoluted portion 22 intermediate the peripheral flange 19 and the inner sleeve portion 21. The convoluted portion 22 is deflected outwardly away from the shoulder 13 and the inner wall 5 to provide a recessed zone 23 for receiving the open end 10 of the inner wall 5.

The sleeve portion 21 is dimensioned to fit closely with the interior wall 12 in a telescoping, sliding relationship to provide a sliding seal area about the interior periphery of the inner wall 5 and thus serves as a closure for the otherwise open end of the annular insulating chamber 8 at the annular aperture 9 while providing communication with the plenum recess 11.

Figure 1:
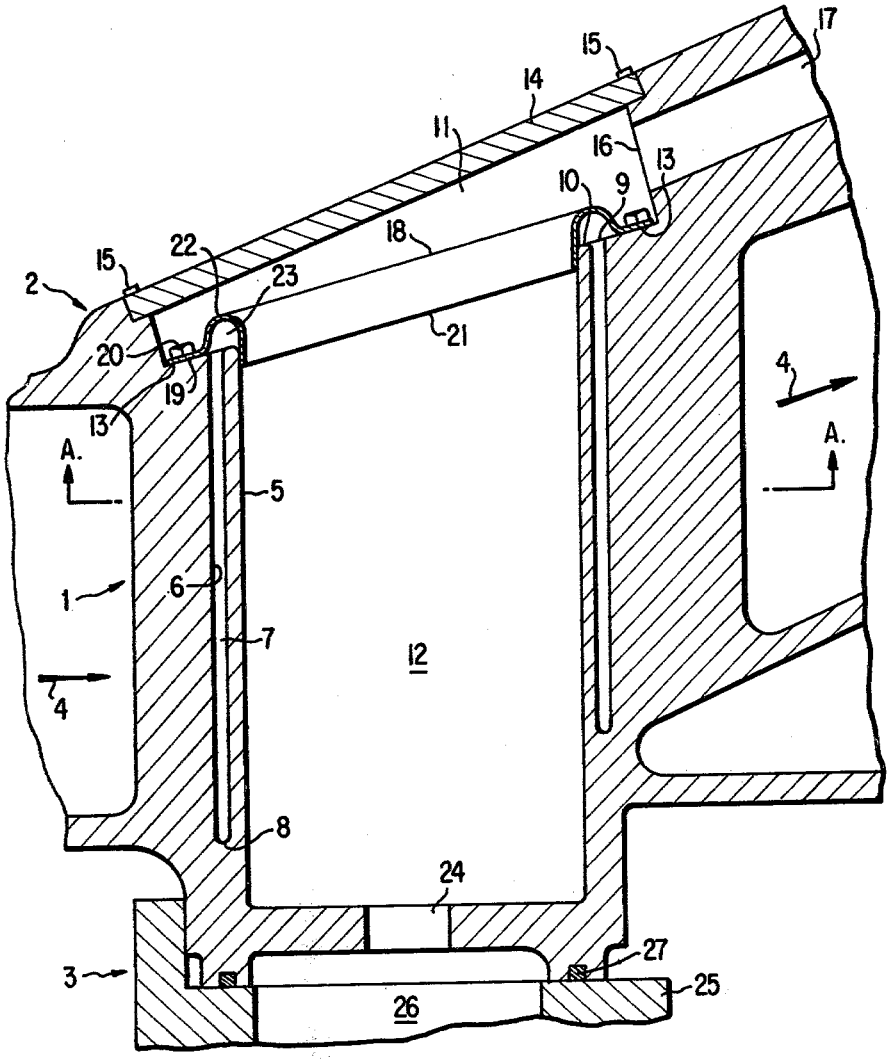
FIG. 1 is a sectional side view of a strut portion of a gas turbine engine and showing the relationship of the strut with the internal and external portions of the engine and a portion of the intermediate gas-flow path through the engine.

At its radially inner end, the interior of the inner wall 5 is provided with any suitable form of aperture, such as that represented at 24, for the transfer of oil to or from the interior of the strut depending upon whether the strut is employed for the supply or the removal of oil with regard to the inner structure 3. The inner structure shown in FIG. 1 is a general representation of a housing 25 supported by the strut and having a plenum zone 26 for oil transfer. A suitable seal 27 may be required to seal the plenum 26 in cases in which the strut and the housing are separately formed.

In service, the inner wall 5 of the strut serves as an oil duct for the transfer of oil either to or from the inner structure 3 under the influence of a conventional pump (not shown). High temperature gases traversing the gas flow path 4 pass around the exterior surfaces of the exposed outer strut wall 6 and deliver a considerable amount of heat to the wall structure. The insulating chamber 7, however, deters the transfer of heat to the inner wall 5, so that a minimum of heat is presented to the flowing oil at the interior wall 12 of the oil duct.

The reduced heat transfer to the inner wall 5, along with the possible cooling effect of the oil passing along the interior wall 12, results in variations in the relative thermal expansion of the inner and outer walls 5 and 6, with a consequent differential in their relative lengths.

However, effective closure of the insulating chamber 7 is maintained by the sliding seal 18, with its flange 19 closing against the shoulder 13 and its sleeve 21 closing against the interior wall 12. The recessed zone 23 formed by the convoluted portion 22 provides for clearance of the open end 10 of the inner wall 5 while closing between the sealing areas of the flange 19 and the open sleeve 21.

It is to be understood that the insulating chamber 7 may be provided with insulation material, instead of or in addition to the closed air volume disclosed. Further it is to be understood that the insulating chamber may be formed by means of an inserted wall, if desired, instead of the integrally-formed inner wall, as is preferred.

Various changes may be made in the details of the invention, as disclosed, without sacrificing the advantages thereof or departing from the scope of the appended claims.

What is claimed is:

1. A lubricating fluid carrying, supporting strut for use within the gas flow path of a gas turbine engine comprising:

an outer wall;

a tubular wall forming an interior lubricating fluid passage within the strut and being spaced from said outer wall to form an insulating chamber about said interior passage, said chamber having a closed end and an open end; and a unitary seal member having an outer portion secured to the outer wall and being constructed with a convoluted intermediate portion positioned to bridge the open end of the insulating chamber and forming a sleeve portion extending from said intermediate portion to engage the inner wall in a sliding seal relation thereby closing the insulating chamber from the interior passage.

2. A lubricating fluid carrying, supporting strut for use within the gas flow path of a gas turbine engine as described in claim 1 wherein the inner wall and the outer wall are integrally formed.

* * * * *